United States Patent [19]

Zohler

[11] Patent Number: 4,765,058

[45] Date of Patent: Aug. 23, 1988

[54] APPARATUS FOR MANUFACTURING ENHANCED HEAT TRANSFER SURFACE

[75] Inventor: Steven R. Zohler, Manlius, N.Y.

[73] Assignee: Carrier Corporation, Syracuse, N.Y.

[21] Appl. No.: 82,017

[22] Filed: Aug. 5, 1987

[51] Int. Cl.[4] ..... B23P 15/26

[52] U.S. Cl. ..... 29/727; 29/157.3 A; 72/98; 72/370

[58] Field of Search ..... 29/157.3 A, 157.3 R, 29/726, 727; 72/98, 78, 370

[56] References Cited

U.S. PATENT DOCUMENTS

| | | | |
|---|---|---|---|
| 3,906,604 | 9/1975 | Kakizaki et al. | 29/157.3 A |
| 4,425,696 | 1/1984 | Torniainen | 29/727 |
| 4,692,978 | 9/1987 | Cunningham et al. | 29/157.3 A |

FOREIGN PATENT DOCUMENTS

| | | | |
|---|---|---|---|
| 572325 | 3/1959 | Canada | 29/157.3 A |
| 0038667 | 3/1977 | Japan | 29/157.3 A |
| 0038666 | 3/1977 | Japan | 29/157.3 A |
| 0044256 | 4/1979 | Japan | 29/727 |
| 0101760 | 8/1979 | Japan | 29/157.3 A |
| 0040233 | 3/1983 | Japan | 29/727 |

*Primary Examiner*—Mark Rosenbaum
*Assistant Examiner*—Irene Cuda
*Attorney, Agent, or Firm*—Robert H. Kelly

[57] ABSTRACT

An apparatus for producing a high performance evaporator tube having a subsurface channel formed between adjacent helical fins with the subsurface channels having alternating closed portions and open pores above the subsurface channels. The fins of the tube are rolled-over toward the adjacent fin and then contacted with a notched disc to form the alternating closed portions and open pores.

2 Claims, 3 Drawing Sheets

APPARATUS FOR MANUFACTURING ENHANCED HEAT TRANSFER SURFACE

BACKGROUND OF THE INVENTION

This invention relates generally to a heat exchange apparatus for use with a boiling liquid and a method of an apparatus for forming the enhanced surface of the heat exchanger apparatus. More particularly, this invention relates to a heat exchanger tube having a surface of integral subsurface channels having pores spaced along the surface thereof to improve the performance of such tube, and a method and apparatus wherein helical external fins forming subsurface channels are rolled over by a notched roller to form spaced pores around each helix.

Tubes manufactured in accordance with the present invention are used in a heat exchanger of the evaporator type wherein a fluid to be cooled is passed through the tubing and a boiling liquid, usually refrigerant, is in contact with the exterior of the tubing whereby heat is transferred from the fluid in the tubing to the boiling liquid. As disclosed in U.S. Pat. No. 4,425,696 an enhanced evaporator tube having subsurface channels communicating with the surroundings of the tube through openings located above an internal rib is manufactured according to a method whereby a grooved mandrel is placed inside an unformed tube and a tool arbor having a tool gang thereon is rolled over the external surface of the tube. The unformed tube is pressed against the mandrel to form at least one internal rib on the internal surface of the tube. Simultaneously, an external fin convolution is formed on the external surface of the tube by the tool arbor with the tool gang. The external fin convolution has depressed sections above the internal rib where the tube is forced into the grooves of the mandrel to form the rib. A smooth roller-disc on the tool arbor is rolled over the external surface of the tube after the external fin is formed. The smooth roller disc is designed to bend over the tip portion of the external fin to touch the adjacent fin convolution only at those sections of the external fin which are not located above an internal rib. The tip portion of the depressed sections of the external fin, which are located above the internal rib, are bent over but do not touch the adjacent convolution thereby forming a pore which provides fluid communication between the surroundings of the tube and the subsurface channels of the tube.

In U.S. Pat. No. 4,313,248 a method is disclosed for forming the heat transfer surface for a heat transfer tube whereby a finning disc forms fins on the surface of a tube and a roller disc compresses the top surface of adjacent fins downwardly to form a narrow gap between adjacent shoulders of adjacent fins.

The creation of high performance heat exchanger tubes has been pursued because it has been found that the transfer of heat to a boiling liquid is enhanced by the creation of vapor entrapment sites or cavities. It is theorized that the provision of vapor entrapment sites assist nucleate boiling. According to this theory the trapped vapor forms the nucleus of a bubble, at or slightly above the saturation temperature, and the bubble increases in volume as heat is added until surface tension is overcome and a vapor bubble breaks free from the heat transfer surface. As the vapor bubble leaves the heat transfer surface, liquid refrigerant enters the vacated volume trapping the remaining vapor and another bubble is formed. The continual bubble formation together with the convection effect of the bubbles traveling through and mixing the boundary layer of superheated liquid refrigerant, which covers the vapor entrapment sites, results in improved heat transfer. Also, it is known that excessive influx of liquid from the surroundings can flood or deactivate a vapor entrapment site. In this regard, a heat transfer surface having a continuous gap between adjacent fins reduces the performance of the tube. Further, enhanced tubes having subsurface channels communicating with the surroundings through surface openings or pores having a specified "opening ratio", although they may prevent flooding of the subsurface channel, are generally limited to having openings for the cavities only at those locations above an internal rib or depression in the external surface of the tube.

The performance of enhanced tubes is critically dependent on the size of the subsurface channels and pores above the subsurface channels, and the number of and spacing between the pores. It is therefore important to manufacture externally enhanced tubes having consistent subsurface channels and pores around the circumference of the tube. It has been determined that in order to improve the performance of enhanced tubes the quantity of pores must be much higher than presently obtained by using an internal rib to form the pores thereabove. The present invention is generally provided with approximately eighty fores around the circumference per subsurface channel.

Thus, there is a clear need for a high performance tube having an enhanced outer surface with a plurality of subsurface channels communicating with the outside space through an increased number of evenly spaced fixed size surface pores that will, to a large extent, overcome the inadequacies that have characterized the prior art.

SUMMARY OF THE INVENTION

It is an object of the present invention to overcome the foregoing difficulties and shortcomings experienced in the prior art and to improve the heat transfer performance of an enhanced evaporator tube manufactured by the process of the present invention.

Another object of the present invention is to improve the performance of an enhanced tube by increasing the number of surface pores in a subsurface channel.

A further object of the present invention is to provide an externally enhanced evaporator tube, having either a smooth internal surface or a grooved internal surface, comprising a plurality of annular or helical subsurface channels on its surface, whereby the subsurface channels communicate with the outside space through spaced pores formed to extend in the direction of the subsurface channels.

A still further object of the present invention is directed to an apparatus for producing a high performance evaporator tube which forms a plurality of subsurface channels on the surface of the tube by means of a fin forming tool and then rolls over a portion of the formed fins into contact with adjacent fins by means of a notched roller which bends the fins at the location contact is made between the fin and the tip of the teeth of the notched roller.

Another object of the present invention is to provide a method of producing a high performance evaporator tube in a production environment which has a plurality of subsurface cavities on the tube surface and a plurality of spaced pores formed to extend in the direction of the subsurface cavities by supporting the internal surface of the tube on a mandrel while contacting the surface of the tube with at least one fin forming disc tool and then bending the formed fins by contacting the formed fins with at least one smooth roller and then finally bending a portion of the rolled-over fin with a notched roller tool until the fin contacts the adjacent fin at the location that the tip of the notched tooth contacts the fin.

These and other objects of the present novel high performance evaporator tube are attained by a novel apparatus and method for forming pores and subsurface channels in enhanced tubes. According to the present invention, a high performance evaporator tube having a plurality of annular or helical subsurface channels communicating with the outside space through a plurality of spaced pores formed to extend in the direction of the subsurface channels is manufactured by a fin forming and fin-bending tool gang. The fin forming tool comprises at least one finning disc, and the fin bending tool comprises a plurality of rollers to bend the fins to form narrow gaps between adjacent fins and a notched roller to depress the bent fins at the location where contact is made between the fin and the teeth of the notched roller.

The various features of novelty which characterize the invention are pointed out with particularity in the claims annexed to and forming part of this specification. For a better understanding of the invention, its operating advantages and the specific objects attained by its use, reference should be had to the accompanying drawings and the descriptive matter in which there is illustrated and described a preferred embodiment of the invention.

BRIEF DESCRIPTION OF THE DRAWINGS

Other objects and advantages of the present invention will be apparent from the following detailed description in conjunction with the accompanying drawings, forming a part of this specification, and in which reference numerals shown in the drawings designate like or corresponding parts throughout the same, and in which.

DESCRIPTION OF THE PREFERRED EMBODIMENT

The high performance enhanced tubes of the present invention are designed for use in an evaporator of a refrigeration system having a fluid to be cooled passing through heat transfer tubes and having refrigerant, which is vaporized, in contact with the external surface of the tubes. Typically, a plurality of heat transfer tubes are mounted in parallel and connected so that several tubes form a fluid flow circuit and a plurality of such parallel circuits are provided to form a tube bundle. Usually, all of the tubes of the various circuits are contained within a single shell wherein they are immersed in the refrigerant. The heat transfer capabilities of the evaporator is largely determined by the average heat transfer characteristics of the individual heat transfer tubes. The size of the subsurface channels and the size, number, and configuration of the pores on the surface of the tubes are particularly critical for R-11 applications. Moreover, the creation of a high performance evaporator tube that can be manufactured from a commercial prime tube in a single pass on a conventional tube finning machine is preferred since it permits more rapid operation and is more cost effective.

Figure 1:
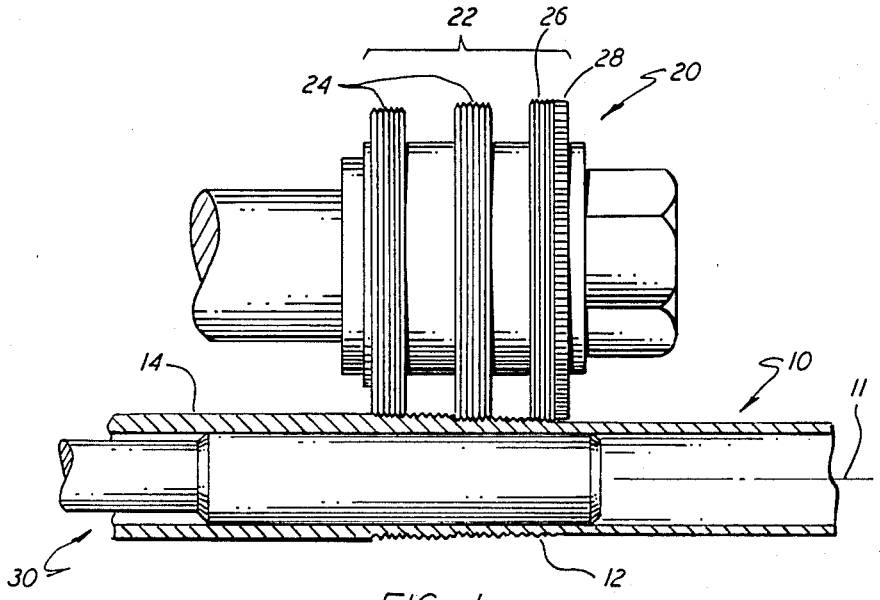
FIG. 1 is a side elevation view of a tube, a smooth mandrel, and a tool arbor having a tool gang thereon for rolling the tube on the mandrel to form the heat transfer tube of the present invention.
Figure 3:
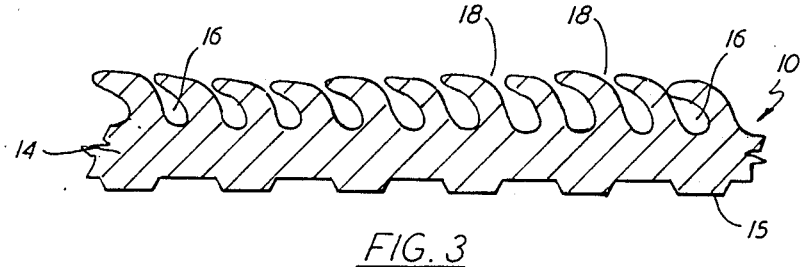
FIG. 3 is a side elevational sectional view on an enlarged scale of the high performance evaporator tube of the present invention with internal ribs.

Referring now to the drawings, FIG. 1 shows the relationship between a tube 10 being enhanced and a tool arbor 20 spaced thereabout and a mandrel 30 inserted therein. Normally, a finning machine contains a plurality of tool arbors, e.g., three spaced 120° apart, but only one tool arbor is shown for clarity. The mandrel 30 is of sufficient length that the interior surface of the tube 10 is supported beneath the tool arbor 20. The mandrel 30 may either be smooth (as shown in FIG. 1) or grooved to form internal ribs (as shown in FIG. 3). However, if the mandrel forms ribs in the tube it is important that the ribs are closely spaced to prevent the external fins located above the ribs from being depressed. The tool arbor 20 with a tool gang 22 is used to form the external fin convolutions 12. The tool gang 22 comprises a plurality of fin forming discs 24 which are used to displace the material of the tube wall 14 of tube 10 to form the helical external fin convolutions 12, and a plurality of roller-like discs 26 to contact the formed fins. A tooth-like notched disc 28 is the last roller-like disc to contact the tube 10.

Figure 2:
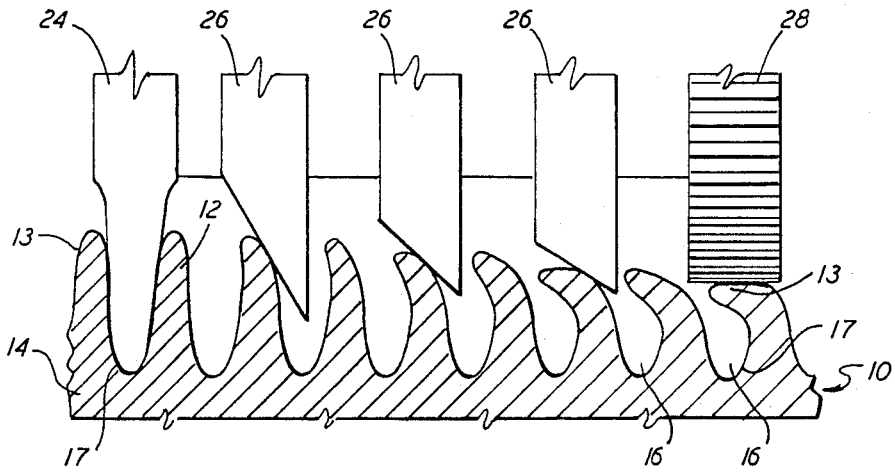
FIG. 2 is a fragmentary sectional view on an enlarged scale showing a typical tube being finned, rolled over, and notched by the tool gang arrangement of the present invention.

As shown in FIG. 2 the external fin convolution 12 is formed by the fin forming discs 24. Subsequently, the smooth roller-like discs 26 roll over the tip portion 13 of the fin convolution 12 toward the adjacent convolution to form subsurface channels 16.

Figure 4:
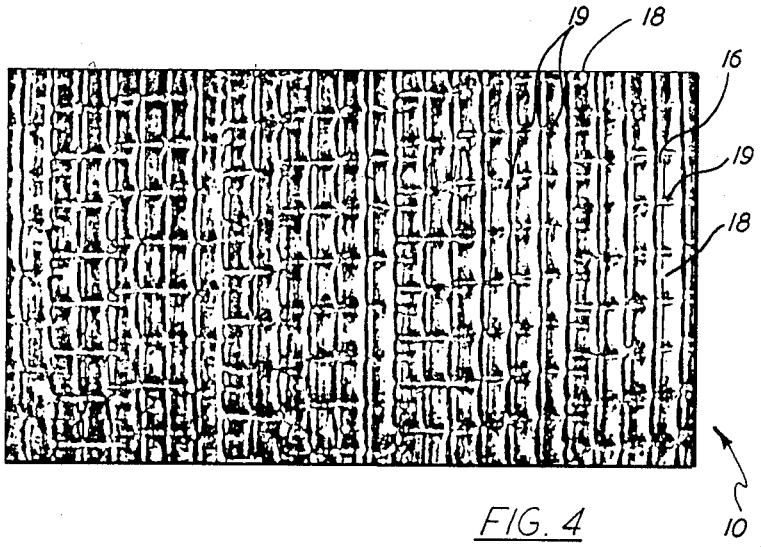
FIG. 4 is a 10X photograph of the surface of the high performance evaporator tube of the present invention.

The high performance evaporator tube of the present invention can be easily manufactured with the apparatus and method as shown in FIGS. 1 and 2. Accordingly, in operation, an unformed tube 10 is placed over the mandrel 30. The mandrel 30 is of sufficient length that the interior surface of the tube 10 is supported beneath the tool arbor 20. The tool gang 22 on the tool arbor 20 is brought into contact with the tube 10 at a small angle relative to the longitudinal axis 11 of the tube 10. This small amount of skew provides for tube 10 being driven along its longitudinal axis as tool arbors 20 are rotated. The fin forming discs 24 displace the material of the tube wall 14 to form the external fin convolution 12 having a root portion 17 and a tip portion 13 while at the same time depressing the tube 10 against the mandrel 30. Generally, the discs 24 form between forty-five and sixty fins per inch along the longitudinal axis of the tube for maximum performance. When the tube mandrel 30 is grooved, depressing the tube 10 against the grooved mandrel will displace the tube wall 12 into the grooves of the mandrel to form internal ribs 15. FIG. 3 illustrates the configuration of a tube formed with a grooved mandrel after the fin forming discs 24, roller-like discs 26, and tooth-like notched disc 28 are rolled over the exterior of the tube 10 to form subsurface channels 16 and surface pores 18, and the ribs 15 are formed on the internal surface. The internal ribs 15 are closely spaced to prevent undulations from being formed on the exterior surface of the tube. A generally smooth exterior surface provides for constant height fins, thereby insuring that the roller discs and notched disc contact the fins evenly. As clearly shown in FIG. 4, the tool arbor 20 creates a pattern of helical subsurface channels 16 having cavity openings or pores 18 alternating with closed sections 19, on the exterior of the tube 10. For the tubes shown in FIGS. 1–4, with a smooth internal wall or internal ribs (as shown in FIG. 3), the enhanced surface area pattern is generally similar because the initial height of the fin convolutions 12 formed on the surface of the tube is generally equal along the entire length of the tube. A typical tube having either a smooth mandrel or a mandrel with greater than 36 grooves about its circumference and used with a tool gang to form more than 40 fins per inch along the longitudinal axis of the tube creates a pattern of open sections, corresponding to the pores 18 and closed sections 19 as a result of the final tooth-like notched disc 28 contacting the roller over fins. This alternating open pore and closed section provides improved performance when there are generally eighty pores around the circumference of the tube along a subsurface channel.

Figure 5:
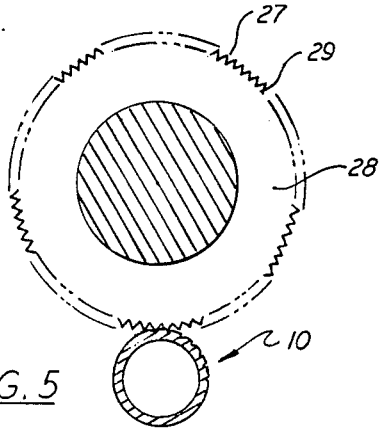
FIG. 5 is an elevational sectional view of the final notched roller of the tool gang of the present invention forming the enhanced surface shown in FIG. 4.
Figure 6:
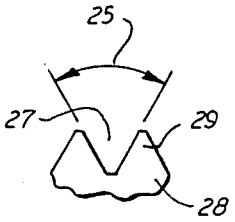
FIG. 6 is an enlarged view of the teeth of the final notched roller as shown in FIG. 5.

Referring now to FIGS. 5 and 6, the general construction details of the final tooth-like notched disc 28 are shown. Accordingly, in operation of the preferred embodiment, e.g. having a tool arbor 20 as shown in FIG. 1, the notched disc 28 contacts the previously rolled over fin convolutions 12 and forms closed sections 19. The notched disc 28 has a plurality of alternating projections or tooth-like protrusions 29 and V-shaped notches 27 about the circumference of the disc. A typical notched disc 28 has between 190 and 220 protrusions. Thus, the notched disc 28 depresses the rolled over fins at the location contact is made between the rolled over fin and the protrusion 29. The contact between the tube 10 and the notched disc 28 creates a pattern of surface pores 18 and closed sections 19, where adjacent fins contact each other, above subsurface channel 16. For the notched disc 28, a typical V-shaped notch 27 is truncated and has an inclusive angle 25 between 35° and 45° as shown in FIG. 6.

Figure 7:
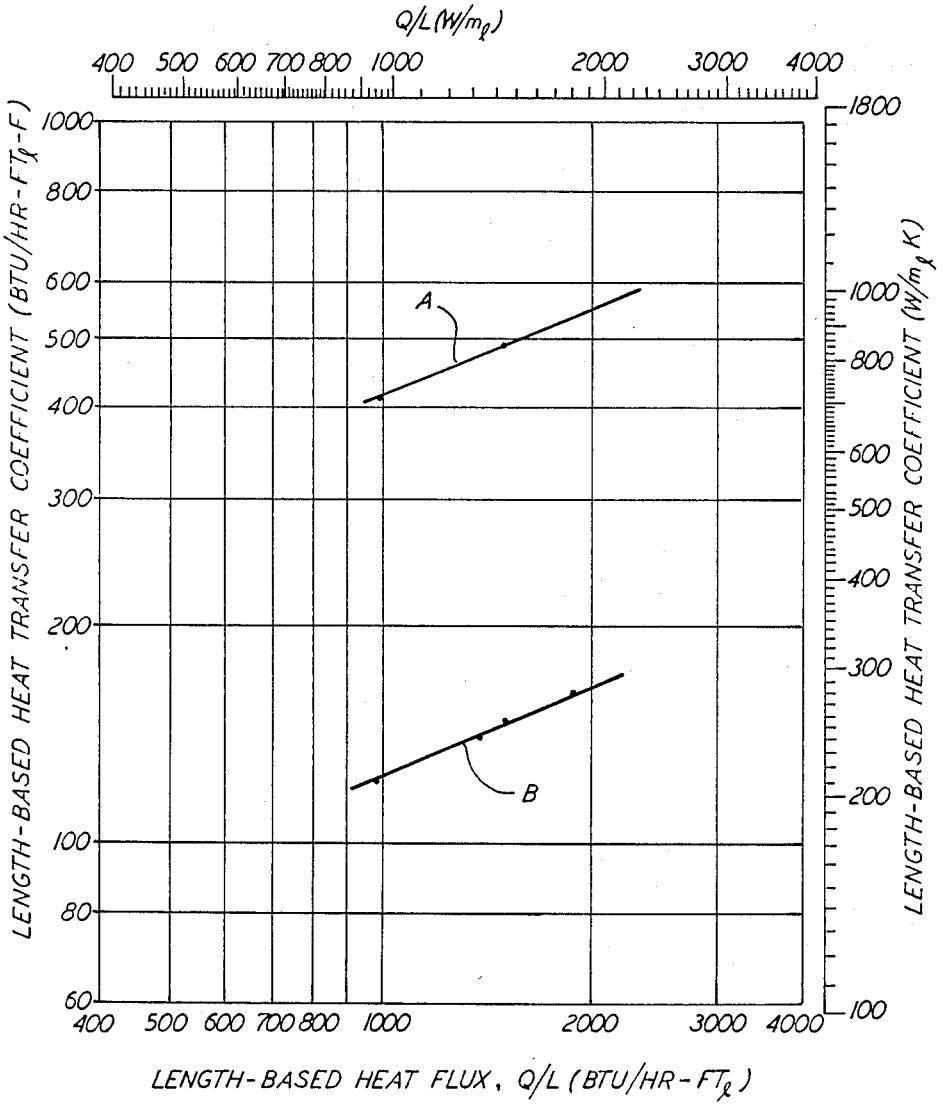
FIG. 7 is a graphical representation of the boiling performance of the high performance evaporator tube of the present invention in comparison with a prior enhanced tube.

Referring now to FIG. 7, there is graphically shown a comparison of length-based heat transfer coefficient and length-based heat flux between tube "A", embodying a tube of the present invention, and tube "B", embodying an enhanced evaporator tube of the prior art. To obtain the measured length-based heat transfer coefficient of the present invention, a three-forths inch copper tube was enhanced with a mandrel having forty-eight grooves about its circumference, a plurality of roller-like discs forming forty-two fins per inch, and a notched disc having one hundred ninety-two protrusions with an inclusive angle of 40° about the circumference of the disc. The sample tube of the present invention was an enhanced tube with the internal fin convolutions having a 30° helix angle, and having forty-two external fin turns per inch, and having an internal rib pattern of forty-eight starts with a distance of approximately 0.070–0.090 inches between grooves, and having surface pores on the order of 0.002–0.005 inches. Tests have shown that a high performance tube should have at least thirty-six internal fins and have at least fifty-three external fins per inch. As graphically shown in FIG. 7, a tube incorporating the present invention was compared, using R-11 at 60° F., with that of a forty-two fin per inch "TURBOCHILL" tube manufactured by the Wolverine Tube Company. As can be seen by the comparison, the high performance evaporator tube "A" in accordance with the present invention exhibits an average of approximately 300% performance improvement over the length-based heat transfer coefficient of the enhanced tube "B".

The foregoing description of the improved high performance evaporator tube and the method of an apparatus for producing the tube using a plurality of fin forming discs, roller discs, and notched discs is directed to a preferred embodiment, and various modifications and other embodiments of the present invention will be readily apparent to one of ordinary skill in the art to which the present invention pertains.

Therefore, while the present invention has been described in conjunction with a particular embodiment, it is to be understood that the various modifications and other embodiments of the present invention may be made without departing from the scope of the invention as described herein and as claimed in the appended claims.

What is claimed is:

1. An apparatus for forming a heat transfer tube from an unformed tube comprising:

a mandrel adapted to be placed inside the unformed tube;

an external fin forming means including a plurality of discs for rolling at least one radially extending fin in the tube;

a fin rolling means for rolling over said radially extending fins to form a subsurface channel between adjacent rolled over fins; and a tooth-like notched disc means having a plurality of alternating projections and V-shaped notches about the circumference of said disc means whereby the projections contact said rolled over fins for matingly engaging adjacent fins at the contact point between said projection and the rolled over fin forming closed portions at said contact point and open pores below said V-shaped notches.

2. An apparatus for forming a heat transfer tube as set forth in claim 1 wherein said tooth-like notched disc means has between 190 and 220 tooth-like protrusions around the outside circumference of said disc means.

* * * * *